US007373893B1

(12) United States Patent
Gutierrez et al.

(10) Patent No.: US 7,373,893 B1
(45) Date of Patent: May 20, 2008

(54) SPINNAKER POLE

(75) Inventors: Joaquin Gutierrez, Buenos Aires (AR); Enrique L. A. Mich, Buenos Aires (AR)

(73) Assignee: King Marine Argentina S.A., Buenos Aires (AR)

( * ) Notice: Subject to any disclaimer, the term of this patent is extended or adjusted under 35 U.S.C. 154(b) by 0 days.

(21) Appl. No.: 11/675,064

(22) Filed: Feb. 14, 2007

(51) Int. Cl.
*B63B 15/00* (2006.01)

(52) U.S. Cl. ..... 114/89

(58) Field of Classification Search ..... 114/89, 114/90, 97
See application file for complete search history.

(56) References Cited

U.S. PATENT DOCUMENTS

| | | | | | |
|---|---|---|---|---|---|
| 377,490 | A * | 2/1888 | Mansfield | 114/90 |
| 3,765,360 | A * | 10/1973 | Monfort | 114/90 |
| 3,813,837 | A * | 6/1974 | McClain et al. | 52/309.1 |
| 3,835,015 | A * | 9/1974 | Gary | 204/196.15 |
| 5,870,877 | A * | 2/1999 | Turner | 52/736.3 |
| 6,739,103 | B1 * | 5/2004 | Noirot | 52/309.1 |

* cited by examiner

*Primary Examiner*—Ed Swinehart
(74) *Attorney, Agent, or Firm*—Richard E. Kurtz; Greenberg Traurig, LLP

(57) ABSTRACT

Methods and apparatuses of for providing a spinnaker pole are disclosed herein. A spinnaker pole as disclosed herein comprises a first elongated face, a second elongated face, a third elongated face, a first tapering, and a second tapering. The first elongated face concaves towards the longitudinal axis of the spinnaker pole. The first elongated face can have two longitudinal sides. A second elongated face concaves towards the longitudinal axis of the spinnaker pole. The second elongated face has two longitudinal sides. One of the two longitudinal sides of the second elongated face is joined to one of the two longitudinal sides of the first face at a first spinnaker pole edge. The third elongated face concaves towards the longitudinal axis of the spinnaker pole. The third elongated face has two longitudinal sides. One of the two longitudinal sides of the third elongated face is joined to one of the longitudinal sides of the first elongated face at a second spinnaker pole edge. One of the two longitudinal sides of the third elongated face is joined to one of the longitudinal sides of the second elongated face at a third spinnaker pole edge. The first tapering is formed by the convergence of the first spinnaker pole edge, the second spinnaker pole edge, and the third spinnaker pole edge towards a first end of the spinnaker pole. The second tapering is formed by the convergence of the first spinnaker pole edge, the second spinnaker pole edge, and the third spinnaker pole edge towards a second end of the spinnaker pole.

16 Claims, 4 Drawing Sheets

SPINNAKER POLE

BACKGROUND

1. Field of the Disclosure

This disclosure generally relates to spars for sailing. In particular, this disclosure relates spinnaker poles, and other spars used to stabilize headsails.

2. General Background

A spinnaker pole is spar used in sailing. Such spars help stabilize and control headsails such as the spinnaker. Because of the multiple forces that spinnaker poles are exposed to, they must be built to withstand a minimum threshold of different forces.

SUMMARY

In one aspect, a spinnaker pole is disclosed. The spinnaker pole can comprise a first elongated face, a second elongated face, a third elongated face, a first tapering, and a second tapering. The first elongated face concaves towards the longitudinal axis of the spinnaker pole. The first elongated face can have two longitudinal sides. A second elongated face concaves towards the longitudinal axis of the spinnaker pole. The second elongated face has two longitudinal sides. One of the two longitudinal sides of the second elongated face is joined to one of the two longitudinal sides of the first face at a first spinnaker pole edge. The third elongated face concaves towards the longitudinal axis of the spinnaker pole. The third elongated face has two longitudinal sides. One of the two longitudinal sides of the third elongated face is joined to one of the longitudinal sides of the first elongated face at a second spinnaker pole edge. One of the two longitudinal sides of the third elongated face is joined to one of the longitudinal sides of the second elongated face at a third spinnaker pole edge. The first tapering is formed by the convergence of the first spinnaker pole edge, the second spinnaker pole edge, and the third spinnaker pole edge towards a first end of the spinnaker pole. The second tapering is formed by the convergence of the first spinnaker pole edge, the second spinnaker pole edge, and the third spinnaker pole edge towards a second end of the spinnaker pole.

In a further aspect, the first spinnaker pole edge, the second spinnaker pole edge, and the third spinnaker pole edge can be reinforced. The spinnaker pole can be reinforced in order to create a higher area moment of inertia along the longitudinal axis of the spinnaker pole. The higher are moment of inertia prevents buckling of the spinnaker pole.

In a further aspect, the first elongated face, the second elongated face, and/or the third elongated face can correspond to a sheet of material configured with a honeycomb structure.

In another aspect, a sailboat is disclosed. The sailboat can comprise a spinnaker sail, a mast and the aforementioned spinnaker pole. In one aspect, a spinnaker pole is disclosed. The spinnaker pole comprises a first elongated face, a second elongated face, and a third elongated face. The first elongated face can have two longitudinal sides. The second elongated face can have two longitudinal sides. One of the two longitudinal sides of the second elongated face is joined to one of the two longitudinal sides of the first face at a first spinnaker pole edge. The first spinnaker pole edge is reinforced so as to have a greater amount of mass than any one of the first elongated face, the second elongated face, or the third elongated face.

The third elongated face can have two longitudinal sides. One of the two longitudinal sides of the third elongated face is joined to one of the longitudinal sides of the first elongated face at a second spinnaker pole edge. The second spinnaker pole edge is reinforced so as to have a greater amount of mass than any one of the first elongated face, the second elongated face, or the third elongated face. One of the two longitudinal sides of the third elongated face is joined to one of the longitudinal sides of the second elongated face at a third spinnaker pole edge. The third spinnaker pole edge is reinforced so as to have a greater amount of mass than any one of the first elongated face, the second elongated face, or the third elongated face.

BRIEF DESCRIPTION OF THE DRAWINGS

By way of example, reference will now be made to the accompanying drawings.

DETAILED DESCRIPTION

Spinnaker poles and methods of manufacturing spinnaker poles are disclosed herein. In an embodiment, a spinnaker pole is configured to have a generally hollow elongated shape. In an embodiment, elongated shape of the pole has a generally triangular cross-section, so as to form a triangular tube. In an embodiment, the triangular tube can be tapered at both ends.

In an embodiment, the spinnaker pole of the present invention has a large percentage of its mass along the edges of the generally triangular cross section. This distribution of mass permits construction of a spinnaker pole with lower overall mass, but which is capable of withstanding the same amount of longitudinal pressure as conventional spinnaker poles. The spinnaker pole configuration disclosed herein provides a lighter spinnaker pole without sacrificing its strength.

In an embodiment, the spinnaker pole has a generally triangular cross-section throughout substantially its entire length. In an embodiment, the walls of the spinnaker pole are concave. The concave walls may help prevent contact or impact with external objects. In addition, the concavity in the walls further strengthens the walls against local buckling. In an embodiment (not shown), the walls of the spinnaker pole may be flat or convex. In an embodiment (not shown), the walls of the spinnaker pole are concave at some portions, and flat or convex at other portions. In an embodiment, the walls of the spinnaker pole are concave toward a middle section of the pole, and flatten toward the tapered sections at the ends.

The spinnaker pole disclosed herein can be utilized as a spar in any type of sailing ship, including, without limitation, yachts and dinghies. In addition, the inventive spar disclosed herein can be used to stabilize a headsail such as spinnakers, jibs and genoas.

Figure 1:
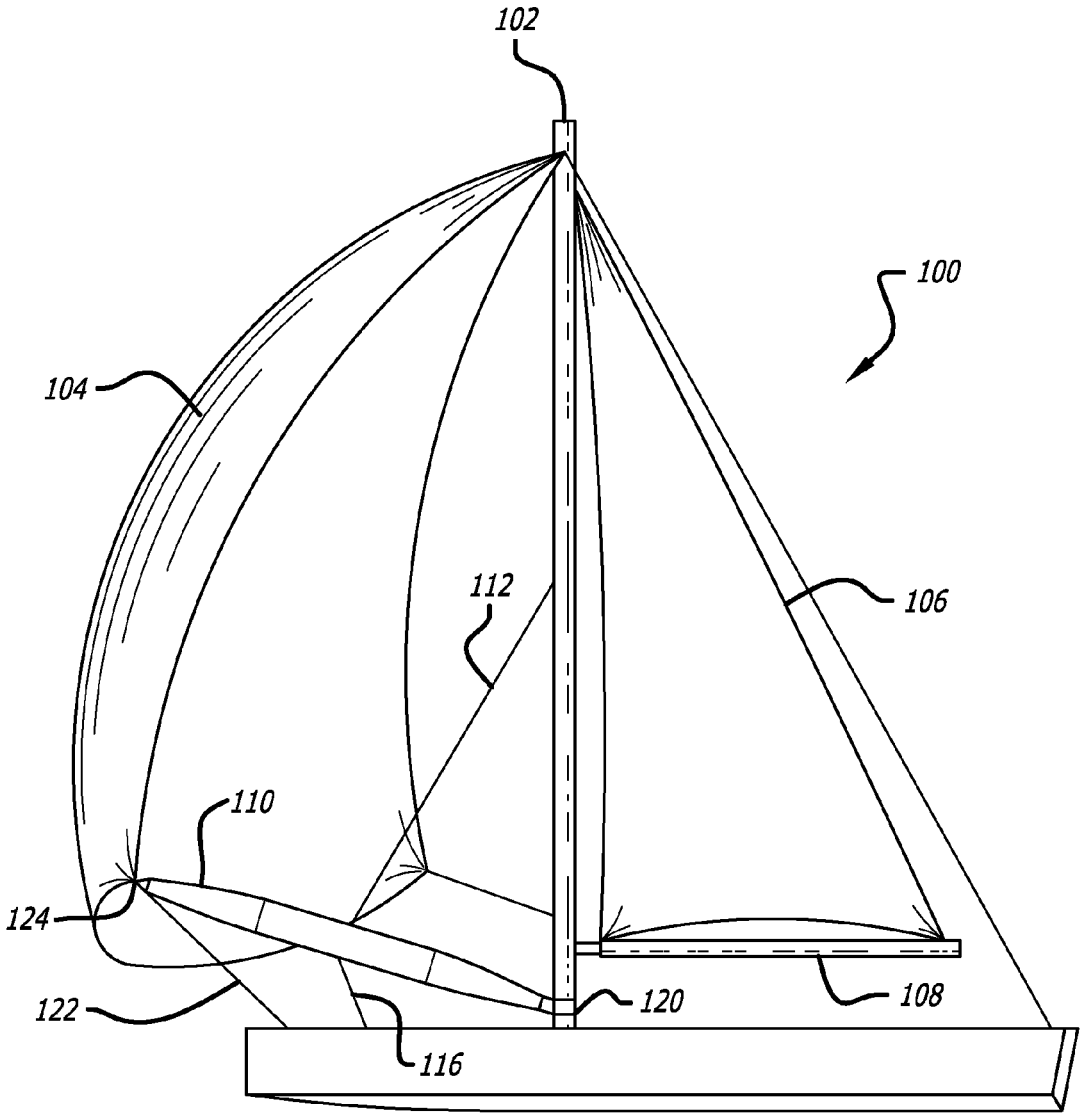
FIG. 1 illustrates a sailboat with a spinnaker sail and corresponding spinnaker pole.

FIG. 1 illustrates a sailboat 100 with a spinnaker sail 104 and a spinnaker pole 110. In an embodiment, the spinnaker pole 110 is an elongated hollow structure having a generally triangular cross-section. In an embodiment, the generally triangular cross-section tapers towards the ends of the spinnaker pole 110. In an embodiment, the spinnaker pole 110 is removably attached at one end (the proximal end) to the mast 102. In an embodiment, the spinnaker pole 110 is removably attached near the base 120 of the mast 102. In an embodiment (not shown), the spinnaker pole can be attached to a location on the mast 102 further from the deck of the sailing vessel.

In an embodiment, the distal end of the spinnaker pole 110 may be removably affixed to the spinnaker sail 104 at the tack 124. In an embodiment, the spinnaker pole 110 can be rigged at the distal end with a guy 122, and the guy 122 can be further rigged to the tack of the spinnaker 104 in order to operatively connect the spinnaker pole 110 to the spinnaker 104. Where a jib (not shown) is used instead of a spinnaker, the distal end of the spinnaker pole 110 can be operatively connected to the clew of the jib via a sheet (not shown).

The spinnaker 104 can be used as a headsail for sailing downwind. Therefore, the spinnaker pole 110 will further receive compression forces along the longitudinal axis of the spinnaker pole 110. These forces demand structural integrity and strength.

The generally triangular configuration of the spinnaker pole 110 permits the spinnaker pole 110 to withstand multiple forces. As discussed later, the generally triangular configuration permits the moment of inertia of the spinnaker pole 110 to be higher even though the same amount of mass is utilized. Therefore, the spinnaker pole 110 can withstand bending forces such as transversal forces perpendicular to the axis of the spinnaker pole 110. In an embodiment, the spinnaker pole 110 is stabilized by a foreguy 116. The foreguy 116 can be rigged (i.e., affixed) to a fitting (not shown) in a middle section of the spinnaker pole 110. The foreguy 116 exerts a generally downward force on the spinnaker pole 110 so as to prevent the spinnaker pole 110 from an unwanted upwards motion, and thus to better control the movement of the spinnaker 104. In an embodiment, a topping lift 112 can be rigged via a fitting (not shown) to the spinnaker pole 110. In an embodiment, the topping lift can be rigged from the mast 102 so as to support the weight of the spinnaker pole 110. As will be appreciated by one skilled in the art, the topping lift 112 and the foreguy 116 exert transverse forces that are generally perpendicular to the longitudinal axis of the spinnaker pole 110. These forces can create stress on the spinnaker pole 110 that could cause a spinnaker pole 110 to break or buckle. The spinnaker pole 110 disclose herein can be built to withstand these transversal forces.

In additional to transversal forces, other forces that such as longitudinal compression and forces can be better handled by the spinnaker pole 110 disclosed herein. These axial forces may also cause the spinnaker pole 110 to bend. As previously discussed, higher moment of inertia of the spinnaker pole 110 permits it to prevent buckling. Therefore, any bending effect of axial forces can be reduced.

In an embodiment, the spinnaker pole 110 is tapered at the ends, thus providing a more aerodynamic design for a spinnaker pole 110. Because the longitudinal axis of the spinnaker pole 110 is positioned generally in the direction of the wind, the tapered ends of the spinnaker pole 110 permit a better flow of wind around the spinnaker pole 110. The tapered ends also inhibit the catching or snagging of rigging on the spinnaker pole 110. Furthermore, the tapering of the ends also reduces weight. In addition, tapering allows a higher moment of inertia near the middle section of the spinnaker pole and a reduced moment of inertia toward the ends. The higher moment of inertia towards the middle section of the spinnaker pole 110 further prevents buckling of the spinnaker pole 110.

Figure 2A:
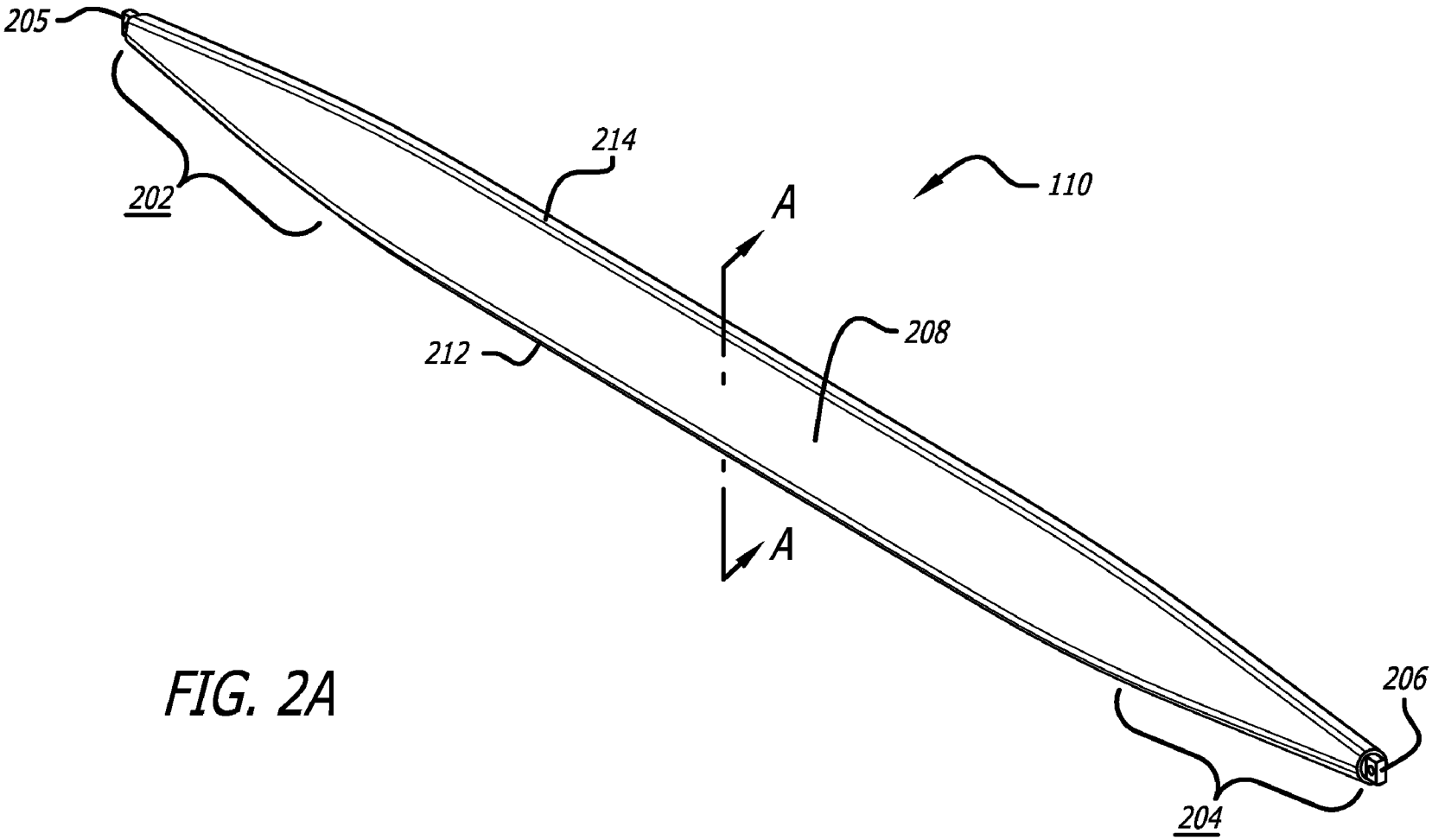
FIG. 2A illustrates a spinnaker pole according to an embodiment.

FIG. 2A illustrates a spinnaker pole 110 according to an embodiment of the invention. The spinnaker pole 110 can include a first tapering 202 and a second tapering 204. As previously mentioned, the tapered ends allow for better aerodynamic flow of air around the spinnaker pole 110. In another embodiment, latches 203 and 206 can be positioned at the ends of the spinnaker pole 110. In an embodiment, latch 206 can be utilized to connect to a fitting on the mast 102. Furthermore, latch 203 can be utilized to connect to a guy 122 that in turn attaches to the tack of the spinnaker 104. Although latches are described above, it will be apparent to one of skill in the art that any appropriate type of fitting or other fastening device can be used to connect the ends of the spinnaker pole 110 to the guy 122 and the mast 102.

Figure 2B:
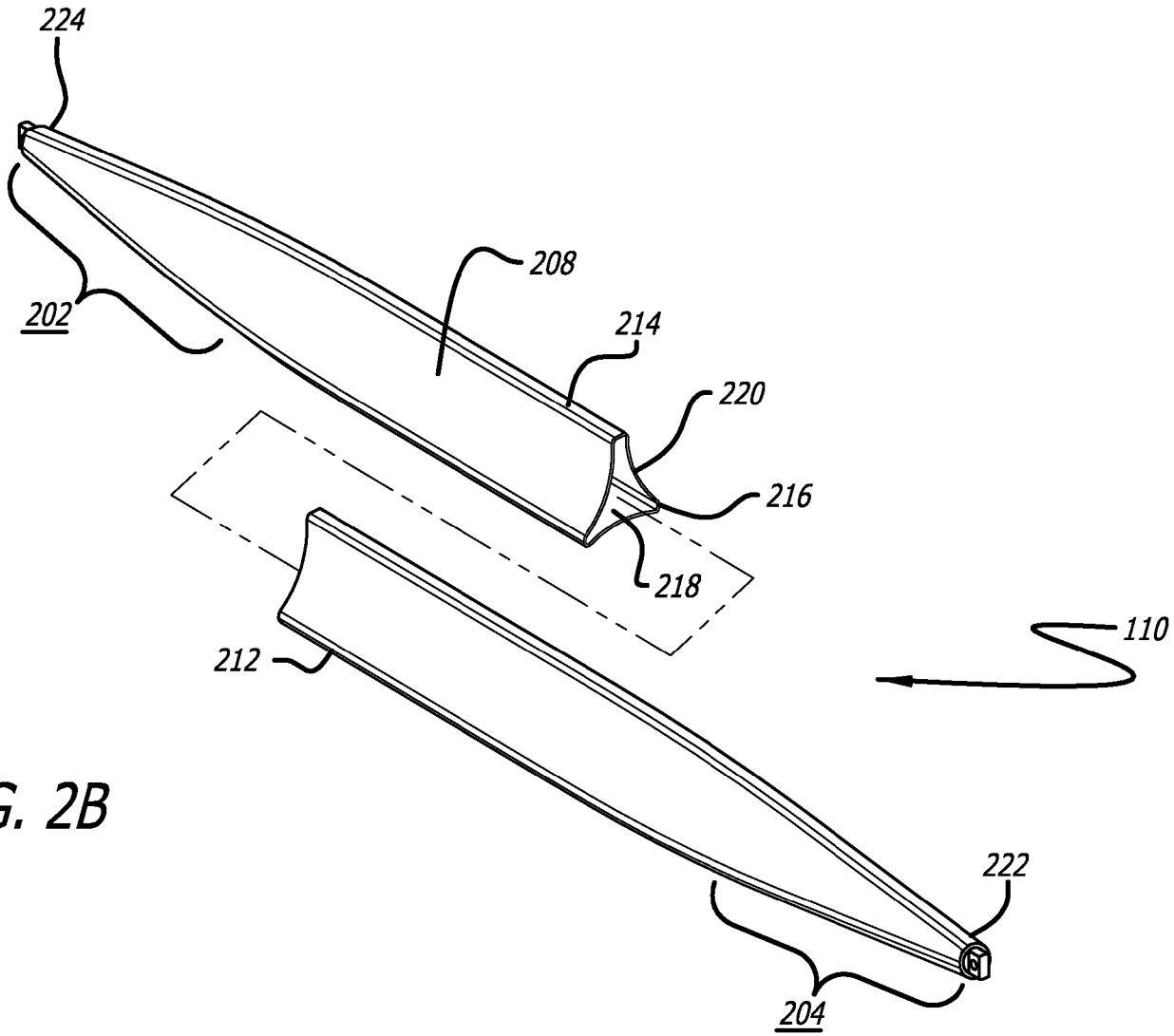
FIG. 2B illustrates an exemplary spinnaker pole separated by a transversal cut across line A-A of FIG. 2 according to an embodiment.

In an embodiment, the spinnaker pole 110 has three concave faces that are assembled together to form a generally triangular, tubular shape. Face 208 can be seen clearly in FIG. 2A. Face 208 comprises an elongated area that abuts longitudinal edge 212, and a longitudinal edge 214. The other two faces and other edge can not be seen in FIG. 2A Turning now to FIG. 2B, an inventive spinnaker pole 110 separated by a transverse cut across line A-A of FIG. 2A. As can now be clearly seen in the drawing, the spinnaker pole 110 comprises three faces 208, 220, and 218. Face 208 abuts edges 212 and 214, face 220 abuts edges 216 and 214, and face 218 abuts edges 212 and 216. In an embodiment, the faces 208, 218, 220 and edges 212, 214, 216 form the longitudinal length of the spinnaker pole 110.

In an embodiment, the first tapering 202 is formed by a tapering of the faces 208, 218, 220, causing convergence of the edges 212, 214, and 216 at the spinnaker pole end 224. In an embodiment, the second tapering 204 is formed by a tapering of the faces 208, 218, 220, causing convergence of the edges 212, 214, and 216 at the spinnaker pole end 222.

Figure 3A:
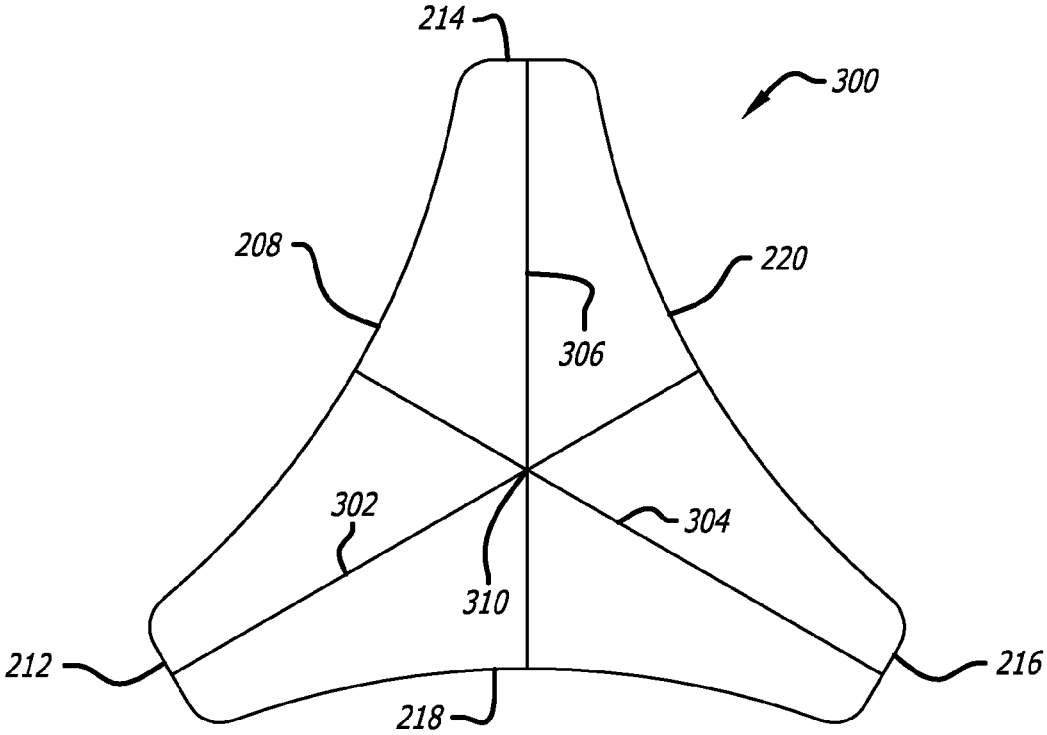
FIG. 3A illustrates an outline of a cross section of the spinnaker pole according to an embodiment.

FIG. 3A illustrates an outline 300 of a cross-section of the spinnaker pole 110 according to an embodiment of the invention. Outline 300 is an outline of the cross-section across line A-A illustrated in FIG. 2A. As previously mentioned, in an embodiment, the spinnaker pole 110 is configured to have a generally triangular shape as shown in the cross-section 300. Faces 208, 218, and 220 are concave towards the centroid 310 (i.e., the longitudinal axis of the spinnaker pole 110). Furthermore, the faces 208, 218, and 220 and the edges 212, 214 and 216 are joined together to form the spinnaker pole 110.

In an embodiment, the outline 300 of the spinnaker pole 110 has generally the shape of an equilateral triangle. Thus, the distance of line 302 from the middle of face 220 to the edge 212, is equivalent to the distance of line 306 from the middle of face 218 to edge 214, and to the distance of line 304 from the middle of face 208 to edge 216. In an embodiment, the cross-section of the spinnaker pole 110 can have the shape of an irregular triangle.

Figure 3B:
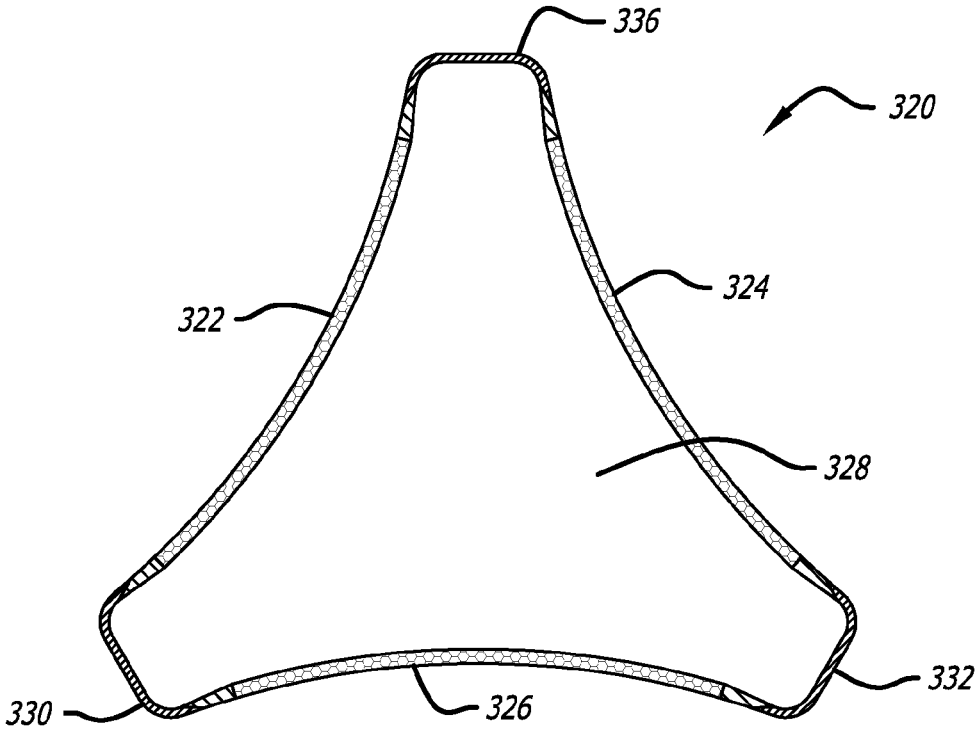
FIG. 3B illustrates another cross section of the spinnaker pole according to an embodiment.

FIG. 3B illustrates another cross-section of the spinnaker pole according to an embodiment. A cross-section 320 illustrates three face sections 322, 324 and 326. In an embodiment, the face sections 322, 324 and 326 can be made of the same material. By way of example, but not by way of limitation, the material can be carbon, glass, tungsten, graphite, titanium, carbon prepreg, aramid honeycomb or a combination of two or more of these materials.

In an embodiment, face sections 322, 324 and 326 and edges 330, 332 and 336 are made of the same materials. In an embodiment, face sections 322, 324 and 326 and edges 330, 332 and 336 are made of different materials. In an embodiment, the face sections 322, 324 and 326 are made of a lightweight honeycomb material that provides a lightweight but robust structure, while the edges 330, 332 and 336 are made of a non-honeycomb material for additional strength. The honeycomb structure can comprise hexagonal compartments that are divided by walls of a pre-selected material. The honeycomb structure allows the faces 322, 324 and 326 to be resilient against compression and forces, and at the same time be lightweight. It will be apparent to one skilled in the art that any material that provides a sufficiently light yet robust structure may be used for the faces or edges.

In addition, the cross section 320 further illustrates a laminated reinforcement 332, 336 and 330 that permits the spinnaker pole 110 to have the highest resilience to impact and other forces at the edges of the spinnaker pole 110. As such, the edges of the spinnaker pole 110 can function as a structural support of the spinnaker pole 110. In an embodiment, the edges of the spinnaker pole 110 may be made of a higher density of material in comparison to other section of the spinnaker pole 110.

In an embodiment, the spinnaker pole 110 is hollow in the middle thus forming a cavity 328. The hollow configuration of the spinnaker pole 110 reduces the amount of mass and weight of the spinnaker pole 110. Therefore, a spinnaker pole 110 having a hollow configuration can comprise three walls that are joined at edges of the spinnaker pole 110.

The reinforced edges 330, 332 and 336 can be configured to have the greatest amount of mass in relation to any other parts of the spinnaker pole 110 such as the faces. Higher concentration of mass on the edges 330, 332 and 336 increases the area moment of inertia of the spinnaker pole 110.

Generally speaking, the moment of inertia of a structural cross-section about an axis is the sum of the moments of inertia of each component part of the structural cross-section about that axis:

$$I_x=\int_A y^2 dA \qquad \text{[Formula A]}$$

In Formula A, y is the distance of the component part to the principal inertia axis x. Therefore, as the distance y increases, the moment of inertia I also increases. Therefore, as more mass is place towards the edges 330, 332 and 336, the spinnaker pole 110, the moment of inertia about any central axis of a cross section of the spinnaker pole 110 increases. Therefore, the spinnaker pole 110 disclosed herein has a greater amount of moment of inertia than a regular triangular beam having a homogenous distribution of mass. In other words, the non-homogenous distribution of the material permits to aggregate more material on the edges of the triangle. As illustrated in FIG. 3B, the edges 330, 332 and 336 are built of reinforced material with greater mass, while the faces 322, 324 and 326 are made of honeycomb material with less mass. Therefore, a greater percentage of the mass is distributed away from the centroid of the cross section 320.

In another example, the amount of mass at each of the edges 330, 332 and 336 is greater than the amount of mass of two of the faces adjacent to the edge. In another example, the amount of mass at each of the edges 330, 332 and 336 is greater than the amount of mass of two of the faces adjacent to the edge. Various other examples of distribution of mass of the edges in comparison with other structures of the spinnaker pole 110 are also contemplated.

Because the moment of inertia of the spinnaker pole 110 with this configuration is greater than other conventional spinnaker poles, the spinnaker pole 110 would withstand greater bending forces than a spinnaker pole that is built using conventional models.

In a further embodiment, the tapered ends 202 and 204 of the spinnaker pole 110 permits the middle portion of the spinnaker pole 110 to have mass distributed farther away from the centroid, and therefore further increase the overall moment of inertia.

As it is well known in the art, geometrical shapes having more than two symmetry axis have the same moment of inertia along any of the axis that cross the centroid of the cross-section. The spinnaker pole 110 has a cross-section having a geometrical shape that has more than one symmetry axis. See lines 302, 304, and 306 in FIG. 3A. Therefore, the moment of inertia would be the same along the axes corresponding to lines 302, 304, and 306, or any other central axis (i.e., an axis crossing centroid 310).

Accordingly, the spinnaker pole 110 with reinforced in the edges can have the same area moment of inertia as a cylindrical spinnaker pole but would require less mass than the mass required for a cylindrical spinnaker pole. Therefore, a lighter spinnaker pole 110 can be built with this configuration. In some examples, the spinnaker pole 110 can be built to have the same area moment of inertia and have less mass as spinnaker poles having other cross sectional shapes. In other examples, the triangular spinnaker pole 110 can be built to have a higher area moment of inertia and have the same mass as spinnaker poles having other cross sectional shapes.

While the above description contains many specifics, these should not be construed as limitations on the scope of the disclosure, but rather as an exemplification of preferred embodiments thereof. The disclosure includes any combination or subcombination of the elements from the different species and/or embodiments disclosed herein. One skilled in the art will recognize that these features, and thus the scope of this disclosure, should be interpreted in light of the following claims and any equivalents thereto.

We claim:

1. A spinnaker pole, comprising:

a first elongated face that concaves towards the longitudinal axis of the spinnaker pole, the first elongated face having two longitudinal sides;

a second elongated face that concaves towards the longitudinal axis of the spinnaker pole, the second elongated face having two longitudinal sides, wherein one of the two longitudinal sides of the second elongated face is joined to one of the two longitudinal sides of the first face at a first spinnaker pole edge;

a third elongated face that concaves towards the longitudinal axis of the spinnaker pole, the third elongated face having two longitudinal sides, wherein one of the two longitudinal sides of the third elongated face is joined to one of the longitudinal sides of the first elongated face at a second spinnaker pole edge, and wherein one of the two longitudinal sides of the third elongated face is joined to one of the longitudinal sides of the second elongated face at a third spinnaker pole edge, and wherein the first spinnaker pole edge, the second spinnaker pole edge, and the third spinnaker pole edge are reinforced so as to create a higher area moment of inertia along any given axis of a cross section of the spinnaker pole;

a first tapering that is formed by the convergence of the first spinnaker pole edge, the second spinnaker pole edge, and the third spinnaker pole edge towards a first end of the spinnaker pole; and a second tapering that is formed by the convergence of the first spinnaker pole edge, the second spinnaker pole edge, and the third spinnaker pole edge towards a second end of the spinnaker pole.

2. The spinnaker pole of claim 1, wherein the higher moment of inertia prevents buckling of the spinnaker pole.

3. The spinnaker pole of claim 1, wherein the first elongated face corresponds to a sheet of material configured with a honeycomb structure.

4. The spinnaker pole of claim 1, wherein the second elongated face corresponds to a sheet of material configured with a honeycomb structure.

5. The spinnaker pole of claim 1, wherein the third elongated face corresponds to a sheet of material configured with a honeycomb structure.

6. The spinnaker pole of claim 1, wherein the spinnaker pole includes a hollow portion at the center of the spinnaker pole.

7. A sailboat, comprising:

a spinnaker sail;

a mast; and a spinnaker pole that attaches to the mast at a first end of the spinnaker pole, and to the spinnaker sail at a second end of the spinnaker pole, the spinnaker pole comprising:

a first elongated face that concaves towards the longitudinal axis of the spinnaker pole, the first elongated face having two longitudinal sides;

a second elongated face that concaves towards the longitudinal axis of the spinnaker pole, the second elongated face having two longitudinal sides, wherein one of the two longitudinal sides of the second elongated face is joined to one of the two longitudinal sides of the first face at a first spinnaker pole edge;

a third elongated face that concaves towards the longitudinal axis of the spinnaker pole, the third elongated face having two longitudinal sides, wherein one of the two longitudinal sides of the third elongated face is joined to one of the longitudinal sides of the first elongated face at a second spinnaker pole edge, and wherein one of the two longitudinal sides of the third elongated face is joined to one of the longitudinal sides of the second elongated face at a third spinnaker pole edge;

a first tapering that is formed by the convergence of the first spinnaker pole edge, the second spinnaker pole edge, and the third spinnaker pole edge towards the first end of the spinnaker pole; and a second tapering that is formed by the convergence of the first spinnaker pole edge, the second spinnaker pole edge, and the third spinnaker pole edge towards the second end of the spinnaker pole.

8. The sailboat of claim 7, wherein the first spinnaker pole edge, the second spinnaker pole edge, and the third spinnaker pole edge are reinforced.

9. The sailboat of claim 7, wherein the first spinnaker pole edge, the second spinnaker pole edge, and the third spinnaker pole edge are reinforced so as to create a higher area moment of inertia along any given axis of a cross section of the spinnaker pole.

10. The sailboat of claim 7, wherein the higher moment of inertia prevents buckling of the spinnaker pole.

11. The sailboat of claim 7, wherein the first elongated face corresponds to a sheet of material configured with a honeycomb structure.

12. The sailboat of claim 7, wherein the second elongated face corresponds to a sheet of material configured with a honeycomb structure.

13. The sailboat of claim 7, wherein the third elongated face corresponds to a sheet of material configured with a honeycomb structure.

14. The sailboat of claim 7, wherein the spinnaker pole includes a hollow portion at the center of the spinnaker pole.

15. A spinnaker pole, comprising:

a first elongated face having two longitudinal sides;

a second elongated face having two longitudinal sides, wherein one of the two longitudinal sides of the second elongated face is joined to one of the two longitudinal sides of the first face at a first spinnaker pole edge; and a third elongated face having two longitudinal sides, wherein one of the two longitudinal sides of the third elongated face is joined to one of the longitudinal sides of the first elongated face at a second spinnaker pole edge, wherein the first spinnaker pole edge is reinforced so as to have a greater amount of mass than the first elongated face, the second elongated face, or the third elongated face, wherein the second spinnaker pole edge is reinforced so as to have a greater amount of mass than the first elongated face, the second elongated face, or the third elongated face, wherein one of the two longitudinal sides of the third elongated face is joined to one of the longitudinal sides of the second elongated face at a third spinnaker pole edge, wherein the third spinnaker pole edge is reinforced so as to have a greater amount of mass than the first elongated face, the second elongated face, or the third elongated face.

16. The spinnaker pole of claim 15, wherein the first spinnaker pole edge, the second spinnaker pole edge, and the third spinnaker pole edge are reinforced, while the faces are built with a honeycomb configuration.

* * * * *